US009556692B1

(12) United States Patent
Cordova et al.

(10) Patent No.: US 9,556,692 B1
(45) Date of Patent: Jan. 31, 2017

(54) VACUUM ASSISTED POST HOLE DIGGER TOOL AND APPARATUS WITH ROTARY CLOG BREAKER

(71) Applicants: Carlos J. Cordova, Los Angeles, CA (US); Sammy Vargas, Rosemead, CA (US)

(72) Inventors: Carlos J. Cordova, Los Angeles, CA (US); Sammy Vargas, Rosemead, CA (US)

(73) Assignee: CORBAS MARKETING, INC., Los Angeles, CA (US)

( * ) Notice: Subject to any disclaimer, the term of this patent is extended or adjusted under 35 U.S.C. 154(b) by 119 days.

(21) Appl. No.: 14/329,904

(22) Filed: Jul. 12, 2014

Related U.S. Application Data

(63) Continuation-in-part of application No. 13/136,924, filed on Aug. 15, 2011, now Pat. No. 8,944,187.

(51) Int. Cl.
*E21B 21/00* (2006.01)
*E21B 21/16* (2006.01)
*E21B 11/00* (2006.01)

(52) U.S. Cl.
CPC ..... *E21B 21/16* (2013.01); *E21B 11/005* (2013.01); *E21B 21/00* (2013.01)

(58) Field of Classification Search
CPC ..... E21B 11/005; E21B 10/60; E21B 21/00; E21B 21/12; E21B 21/16; E21B 21/01; E21B 21/07
See application file for complete search history.

(56) References Cited

U.S. PATENT DOCUMENTS 1,674,392 A * 6/1928 Flansburg ..... E02F 3/413 175/267
3,651,621 A * 3/1972 Davis ..... A47L 7/00 15/340.1
3,958,651 A * 5/1976 Young ..... E21B 21/12 175/213
4,667,750 A * 5/1987 Wise ..... E21B 7/18 175/213

(Continued)

FOREIGN PATENT DOCUMENTS

JP 05311966 A * 11/1993
JP 2001336170 A * 12/2001
JP 2008008034 A * 1/2008

*Primary Examiner* — Daniel P Stephenson
(74) *Attorney, Agent, or Firm* — William L. Chapin

(57) ABSTRACT

A tool for boring holes in soil includes an elongated tubular housing which has disposed through its length a bore having an upper opening coupleable to a vacuum source and a lower opening coupled to the bore of a ring-shaped bore head having circumferentially spaced apart cutting teeth protruding downwards from the bore head. A zig-zag shaped unclogger bar disposed coaxially through the bore head and rotated by a drive shaft disposed coaxially through the tubular and housing and protruding through a bearing in an upper end of the housing and driven by a rotary power source such as an electric motor fixed to the housing fragments lumps of clay or wet soil lodged in the bore of the housing, facilitating removal of soil and clay, which are severed by twisting the tool around its longitudinal axis by manipulating handle bars protruding from the upper end of the housing.

4 Claims, 12 Drawing Sheets

(56) References Cited

U.S. PATENT DOCUMENTS 4,921,374 A * 5/1990 Stutzman ..... F16L 55/175 138/99
4,949,795 A * 8/1990 McDonald ..... E21B 7/002 175/323
5,535,836 A * 7/1996 Cagianut ..... E21B 7/18 166/222
6,470,605 B1 * 10/2002 Gilman ..... E02F 3/8816 37/323
6,578,293 B1 * 6/2003 Ainsworth ..... E02F 3/902 37/317
6,615,849 B1 * 9/2003 Gilman ..... E02F 3/8816 134/167 R
6,751,893 B2 * 6/2004 Sullivan ..... E02F 3/925 37/195
7,185,720 B1 * 3/2007 Menna ..... E21B 11/005 175/209
7,806,205 B2 * 10/2010 Bock ..... E21B 11/005 175/170
8,944,187 B1 * 2/2015 Cordova ..... E21B 21/16 175/213
2002/0194753 A1 * 12/2002 Bain ..... E02F 3/8825 37/317
2006/0118338 A1 * 6/2006 Maybury ..... E21B 21/015 175/213
2007/0110521 A1 * 5/2007 Nimens ..... E02D 7/22 405/232
2009/0185865 A1 * 7/2009 Sharp ..... F16L 55/18 405/157
2010/0098520 A1 * 4/2010 Barone ..... E02F 3/8891 414/680
2010/0196129 A1 * 8/2010 Buckner ..... E02F 3/94 414/467
2013/0189060 A1 * 7/2013 Lamonte ..... E02F 7/00 414/507
2013/0340297 A1 * 12/2013 Buckner ..... E02F 3/8816 37/304
2014/0020268 A1 * 1/2014 Buckner ..... E02F 3/8891 37/304
2014/0042246 A1 * 2/2014 Buckner ..... B05B 3/04 239/381
2015/0034393 A1 * 2/2015 Hutt ..... E21B 11/005 175/213

* cited by examiner

VACUUM ASSISTED POST HOLE DIGGER TOOL AND APPARATUS WITH ROTARY CLOG BREAKER

This application is a continuation-in-part (CIP) of application Ser. No. 13/136,924 filed Aug. 15, 2011.

BACKGROUND OF THE INVENTION

A. Field of the Invention

The present invention relates to tools and implements for making elongated circular cross-section bore holes such as post holes into soil beneath the surface of the ground. More particularly, the invention relates to a hole digger tool and apparatus which uses a vacuum pump to remove soils severed by cutting teeth and has a rotating unclogger bar to break up mud or clay clogs which could impede removal of dislodged soil.

B. Description of Background Art

There are a variety of situations which require making elongated, relatively deep holes into the ground. These include digging generally cylindrically-shaped holes for receiving fence posts, sign posts and the like. Such holes have a typical diameter range of from about 4 inches to about 12 inches, and a depth of 3 to 6 feet or more.

Digging relatively deep, elongated holes such as post holes in the ground tends to be a tedious, slow, labor intensive task, when using conventional manually operated, manually powered digging implements. A widely used manually powered, "clam-shell" post hole digger includes a pair of shovels, each of which has a generally semi-circularly curved blade. The shovel blades are fixed to the lower ends of upwardly protruding handles which are pivotably mounted to one another at a location between the shovel blades and the upper ends of the handles, and arranged so that the concave surfaces of the shovel blades confront one another to define therebetween a generally cylindrically-shaped space corresponding to a hole to be dug.

Clam-shell post hole diggers are used by pivoting the upper ends of the handles also orienting the shovel blades at the lower ends of the handles in generally parallel alignment. The handles are then grasped by an operator to orient them vertically, i.e., perpendicularly to a ground surface into which a post hole is to be dug. The operator then brings his arms down forcefully towards the surface of the ground, thus causing pointed tips of the shovel blades to penetrate the ground soil, and the handles are rocked back and forth in a horizontal direction, to thus impart a twisting cutting motion to the shovel blades.

Next, the upper ends of the handles are drawn apart to thus pivot the shovel blades towards one another, underneath soil which has been loosened by downward and twisting cutting actions of the shovel blades. The claim-shell digger tool is then raised above the ground to thus withdraw the shovel blades from the ground and thereby remove the severed soil, which may then be dumped at any convenient location. This is done by pushing the upper ends of the handles together, thus causing the inner facing concave surfaces of the shovel blades to pivot away from one another, allowing soil supported on those surfaces to fall away from the blades.

The handles are once again put into parallel alignment, and claim-shell digger tool is again thrust downward to thus drive the shovel blades downward into the hole being dug to thereby begin a new cycle of soil excavating. These cycles are repeated as often as required to dig a hole of a desired depth. As can be well appreciated, digging post holes with a clam-shell digging tool of this type is a very laborious, slow task.

Another method of forming post holes which is in common use employs a large diameter auger that is rotated by an electric, hydraulic or air-driven motor. Boring post holes with a powered auger of this type is much quicker and easier than using a claim-shell type digger tool, but the cost of such devices, and the requirement of providing electric, hydraulic or compressed air power to them, limits the extent of their use.

In apparent recognition of certain limitations of clam-shell or auger-type post hole diggers, U.S. Pat. No. 7,185,720 disclosed a hole digger which includes an elongated, skeletonized cylinder that has circumferentially spaced apart, elongated bars which are fastened at the upper ends thereof to the periphery of an upper mounting ring, and near the lower ends of the bars to a lower, mounting ring. The bars extend below the lower mounting ring and terminate in wedge-shaped, pointed cutting teeth.

The digging tool disclosed in U.S. Pat. No. 7,185,720 includes a straight, hollow vacuum tube which fits coaxially down through the bore of the skeletonized frame and is longitudinally movable therewithin. The upper end of the vacuum tube is connected through a flexible vacuum hose to a vacuum source, such as a wet-or-dry shop vacuum unit. The tool is used by pressing the pointed edges of the cutting teeth into a soil surface, twisting the unit back and forth with respect to its longitudinal axis to thus cause the teeth to exert a rotary cutting action on the soil surface, and oscillating the vacuum tube up and down to thus vacuum up severed soil.

While the hole digger implement disclosed in U.S. Pat. No. 7,185,720 appears to be an improvement over certain prior art hole diggers such as clam-shell type hole diggers, the present inventor has found that diggers of the type disclosed in the '720 patent have certain limitations. For example, the requirement that the vacuum tube in the '720 digger be oscillated up and down can become burdensome. Also, the present inventor has found that using vacuum assisted hole diggers of the type described in U.S. Pat. No. 7,185,720 in wet, muddy or clay soil can be problematic, because the mud or clay tends to lodge within the vacuum tube, thus clogging the bore of the vacuum tube and preventing soil from being drawn upwardly through the tube.

The foregoing considerations in part prompted the present invention, which is described in detail below.

OBJECTS OF THE INVENTION

An object of the present invention is to provide a vacuum assisted post hole digger apparatus for boring post holes in soil which includes a vacuum assisted post hole boring tool and a vacuum source.

Another object of the invention is to provide a vacuum assisted post hole digger tool which includes an elongated hollow tubular housing that has a vacuum inlet fitting at an upper end thereof and a plurality of circumferentially spaced apart soil cutting blades or teeth which are attached to the outer circumferential surface of a cylindrical sleeve located at the lower end of the tubular housing, the cutting teeth extending below the lower transverse annular end wall of the sleeve.

Another object of the invention is to provide a vacuum assisted post hole digger tool which includes an elongated zig-zag shaped mud and clay unclogger bar that is attached at an upper end thereof to an elongated drive shaft coaxially positioned within the bore of an elongated hollow tubular housing which has at an upper end thereof a laterally outwardly angled vacuum inlet tube, the drive shaft protruding upwards through a rotatable vacuum-sealing type bearing located in an upper wall of the vacuum inlet tube to thus enable the shaft to be coupled to a rotary power tool such as an electric drill.

Another object of the invention is to provide a vacuum assisted post hole digger tool which includes an elongated zig-zag shaped mud and clay unclogger bar that is attached at an upper end thereof to an elongated drive shaft coaxially positioned within the bore of an elongated hollow tubular housing which has at an upper end thereof a laterally outwardly angled vacuum inlet tube, the drive shaft being coupled at an upper end thereof to an electric motor mounted on the vacuum inlet tube.

Another object of the invention is to provide a vacuum assisted post hole digger tool which includes an elongated zig-zag shaped mud and clay unclogger bar that is attached at an upper end thereof to an elongated drive shaft coaxially positioned within the bore of an elongated hollow tubular housing which has near an upper end thereof a laterally outwardly disposed vacuum inlet tube, the drive shaft having fastened to an upper end thereof a manually rotatable hand crank wheel.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated the present invention comprehends a vacuum assisted post hole digger tool and apparatus for boring relatively deep, longitudinally elongated holes such as post holes into soil.

The vacuum assisted post hole digger apparatus according to the present invention utilizes a novel post hole digger tool which includes an elongated hollow tubular tool housing that has at the; upper end thereof a laterally outwardly disposed vacuum inlet coupling tube. The apparatus includes a vacuum source such as a wet-or-dry shop vacuum powered by an electric motor which is connectable through a flexible vacuum hose to the vacuum inlet coupling tube of the tool.

The post hole digger tool according to the present invention includes a cylindrical ring-shaped bore head which is attached to the lower transverse end of the tubular tool housing. The bore head includes a cylindrical sleeve which is coaxially aligned within the tubular tool housing, and is of approximately the same diameter as the tool housing. The bore head has protruding downwards of the lower transverse annular edge wall thereof a plurality, typically four, of circumferentially spaced apart cutting blades or teeth. In a preferred embodiment, the teeth are attached to the outer circumferential surface of the cylindrically shaped sleeve which comprises the body of the bore head.

The vacuum assisted post hole digger tool according to the present invention includes a longitudinally elongated, zig-zag shaped mud and clay unclogger bar which is attached at an upper end thereof to an elongated drive shaft that extends upwardly through the center of the elongated bore through the tubular tool housing of the tool. The upper end of the drive shaft protrudes through the center of a vacuum-tight bearing fitted in an upper end of the vacuum inlet tube, in coaxial alignment with the bore through the cylindrical tool housing.

The post hole digger tool according to the present invention includes a pair of transversely aligned cylindrically-shaped turnstile-type handles which protrude perpendicularly outwards form opposite sides of the tubular housing. The handles are located in a horizontal plane a short distance below the upper transverse end of the housing below the vacuum inlet coupler tube.

The vacuum assisted post hole digger tool according to the present invention is used by first connecting the outer, inlet end of the vacuum inlet coupler tube through a flexible hose to a vacuum source, such as an electrically powered wet-or-dry shop vacuum unit which includes a blower that has a vacuum inlet port and a cannister for collecting debris discharged from the output port of the blower. Next, the handles of the tool are grasped, and the tool lifted to position it vertically above a ground surface in which a hole is to be bored. The tool is then lowered to place the bore head teeth in contact with a ground surface. The tool handles are then toggled, i.e., cyclically rocked fore and aft in clockwise and counterclockwise directions, e.g., plus and minus 90 degrees, to thus cause the bore head cutting teeth to penetrate the ground, assisted by downward force exerted by the weight of the housing.

The vacuum source is then turned on, and maintained on while the tool handles are rocked back and forth. Earth loosened by the cutting teeth is drawn up through the hollow bore of the tool housing by the vacuum source, facilitating boring action of the teeth.

When the vacuum assisted post hole digger tool is used in wet, muddy soil or in clay, the upper end of the drive shaft of the mud unclogger bar which protrudes upwards form the vacuum inlet tube is coupled to a rotary power source, such as by being clamped in the chuck of an electric drill. The rotary power source is then energized while the tool is in use, causing the mud unclogger bar to rotate, pulverize and break up mud or clay clogs which could otherwise form and prevent vacuum removal of severed soil material.

A modified version of the post hole digger tool according to the present invention replaces a curved, two-port vacuum inlet tube with a three-port tubular Tee which has a laterally outwardly protruding side section for connection to a vacuum source, and an in-line section which has an upper entrance opening capped with a bearing cap that rotatably holds the upper end of the unclogging bar drive shaft, which has attached to the upper end thereof a hand wheel which is manually rotatable to thus rotate the unclogging bar.

DESCRIPTION OF THE PREFERRED EMBODIMENTS

Figure 14:
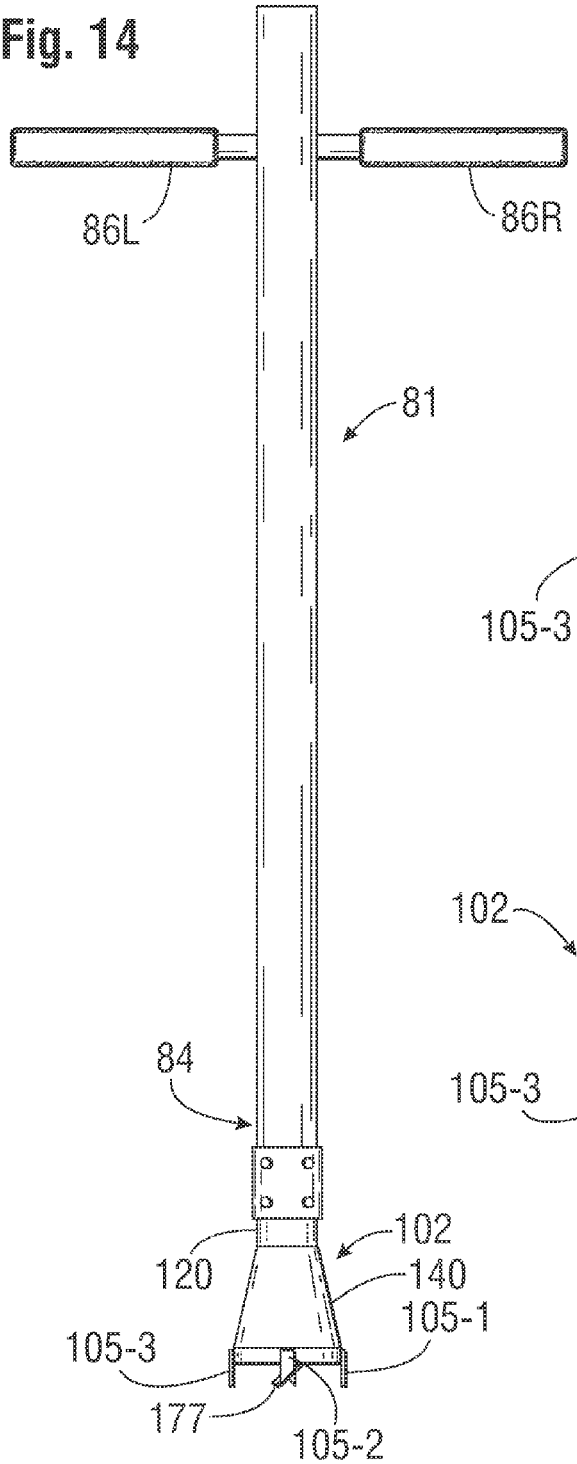
FIG. 14 is an elevation view of a modification of the tool of FIG. 2, which has a larger diameter bore head.
Figure 15:
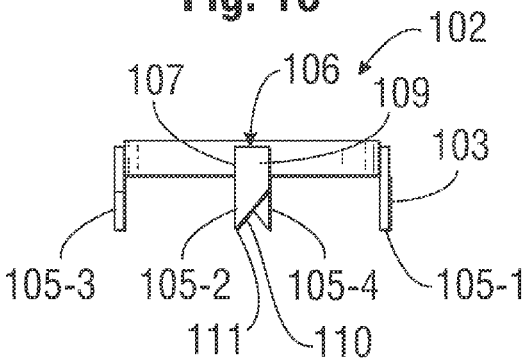
FIG. 15 is a fragmentary view of the tool of FIG. 14, showing a bore head thereof.
Figure 16:
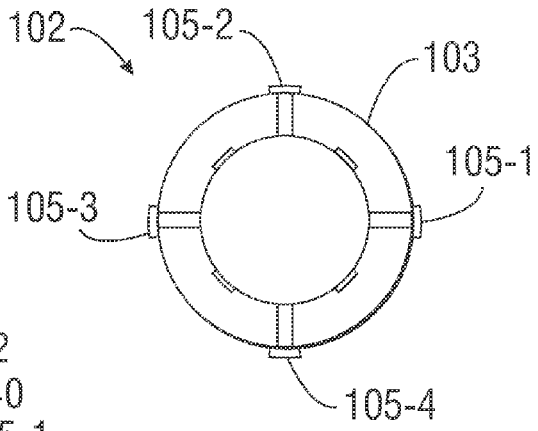
FIG. 16 is a lower plan view of the bore head of FIG. 15.
Figure 17:
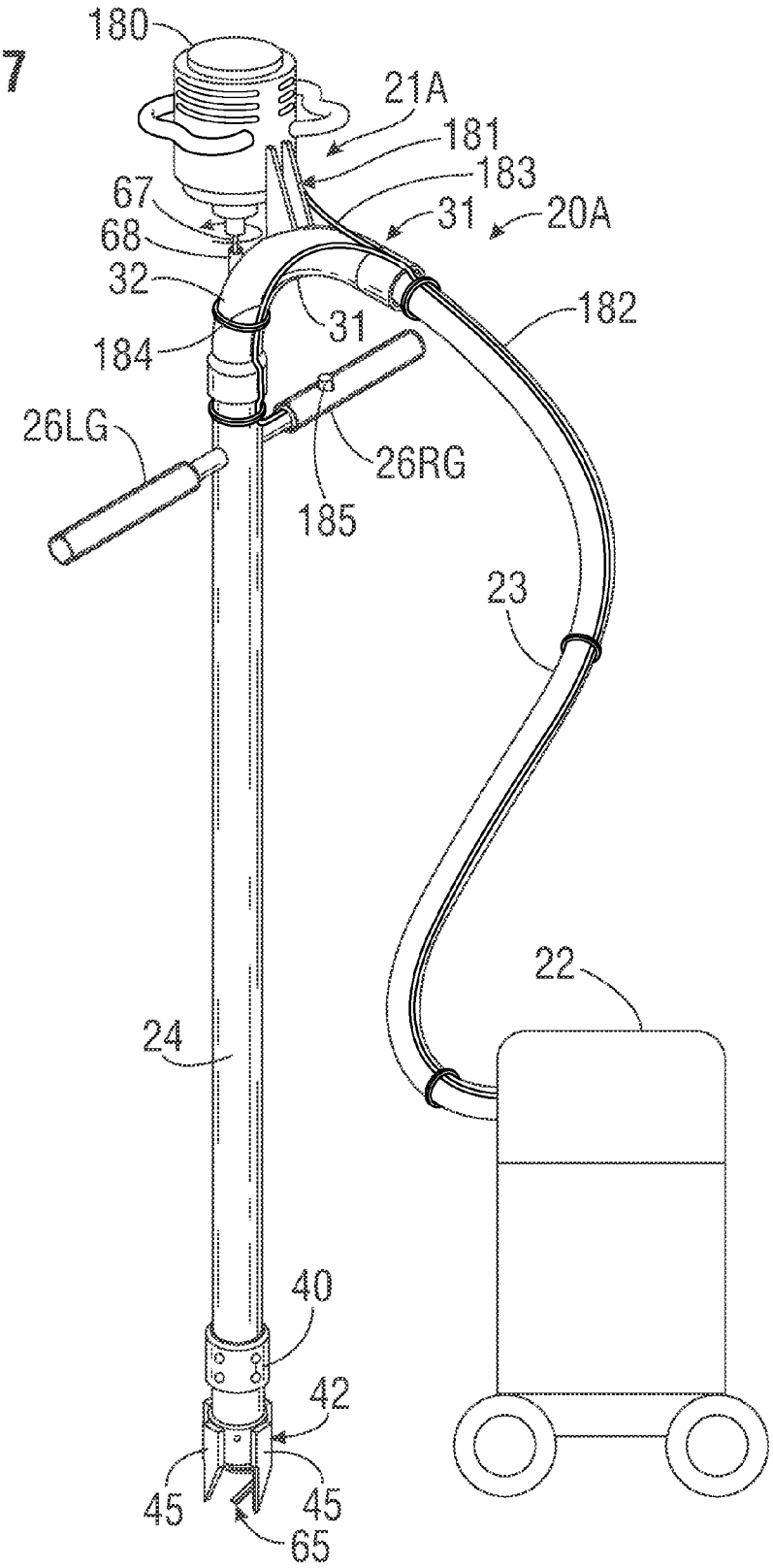
FIG. 17 is a perspective view of another modification of the tool of FIG. 2, which has an integral drive motor for rotating the mud and clay unclogger bar of the tool.

FIGS. 1-8 illustrate a basic embodiment of a vacuum assisted post hole digger tool and apparatus with rotary clog breaker according to the present invention. FIGS. 9-13 illustrate operation of the post hole digger tool and apparatus according to the present invention. FIGS. 14-16 illustrate a modification of the tool of FIGS. 1-8, which is useable for making larger diameter holes. FIG. 17 illustrates a modification of the tool of FIGS. 1-8 which includes an integral drive motor for rotating a mud and clay unclogger bar of the tool.

Figure 19:
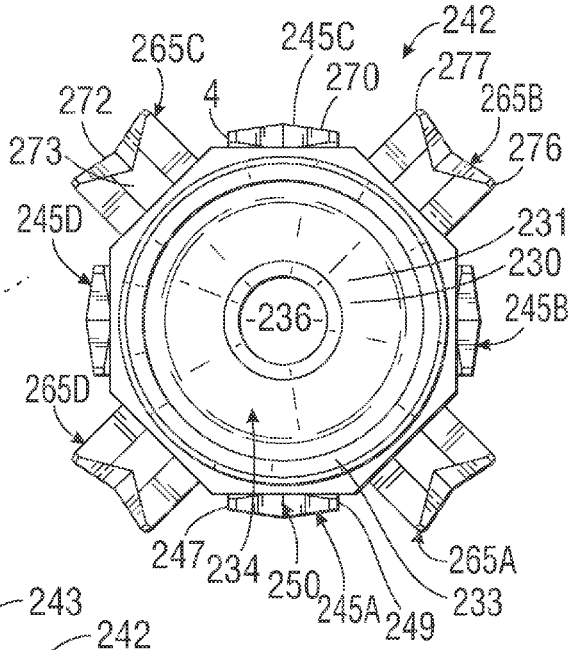
FIG. 19 is a lower plan view of the bore head of FIG. 18.
Figure 18:
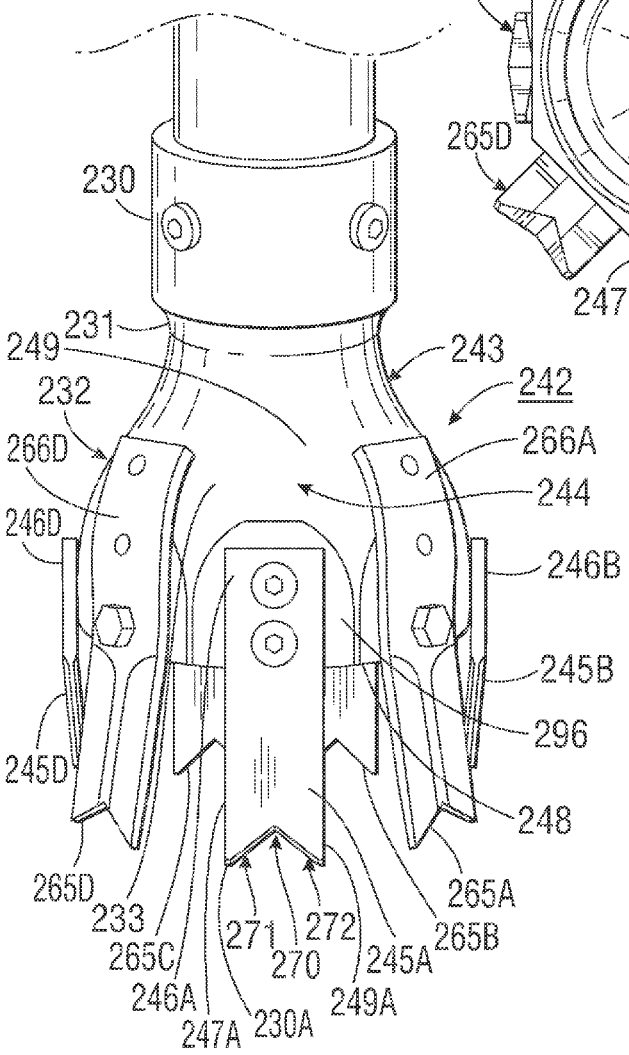
FIG. 18 is an elevation view of a modified bore head for the tools of FIGS. 1-14.

FIGS. 18 and 19 illustrate a modified bore head for use with tools shown in FIGS. 1-17, for use in making large holes.

Figure 20:
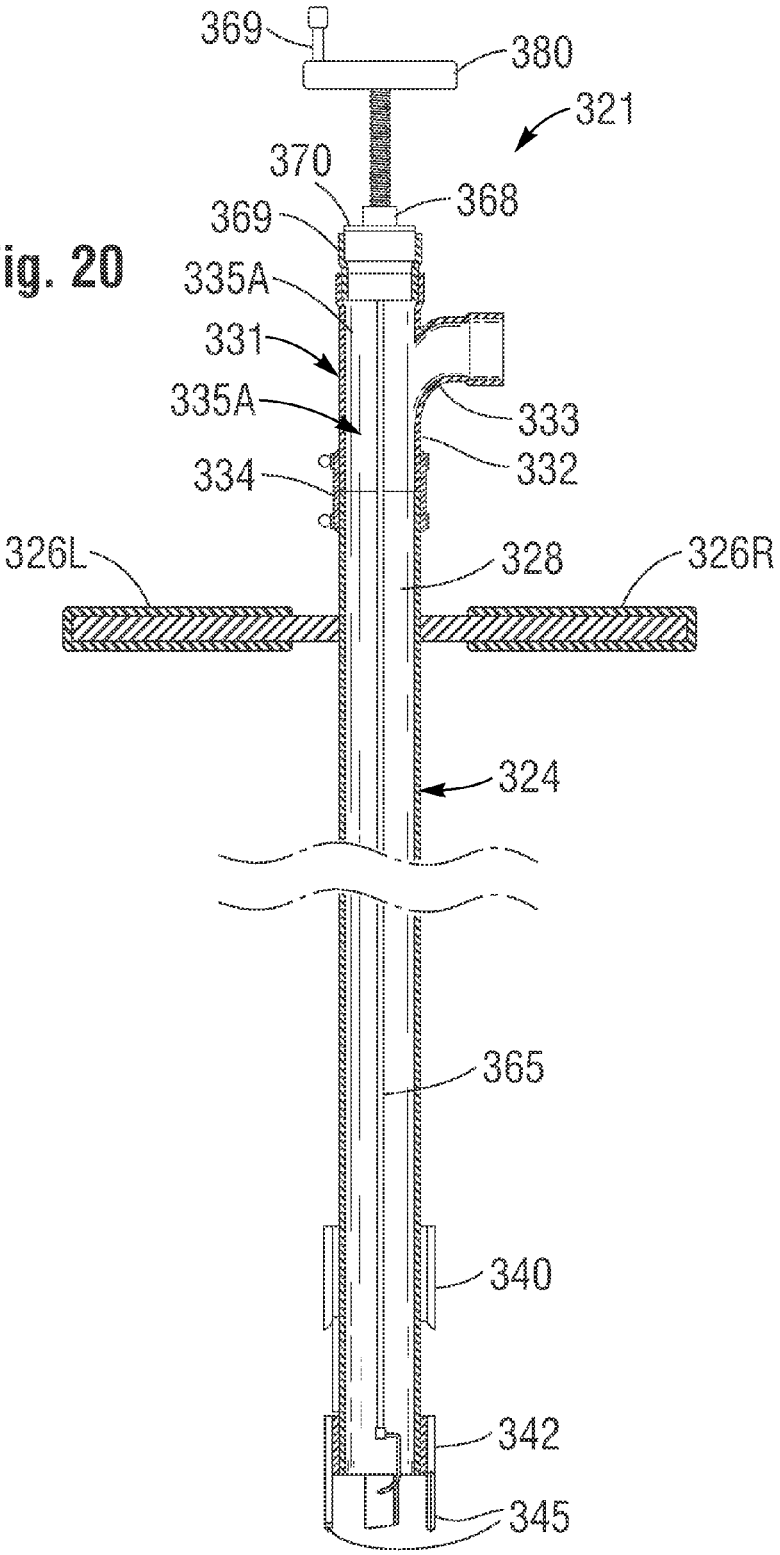
FIG. 20 is a longitudinal medial sectional view of another modification of the tool of FIG. 17, which has a manually rotatable hand wheel for rotating the mud and clay unclogger bar.
Figure 21:
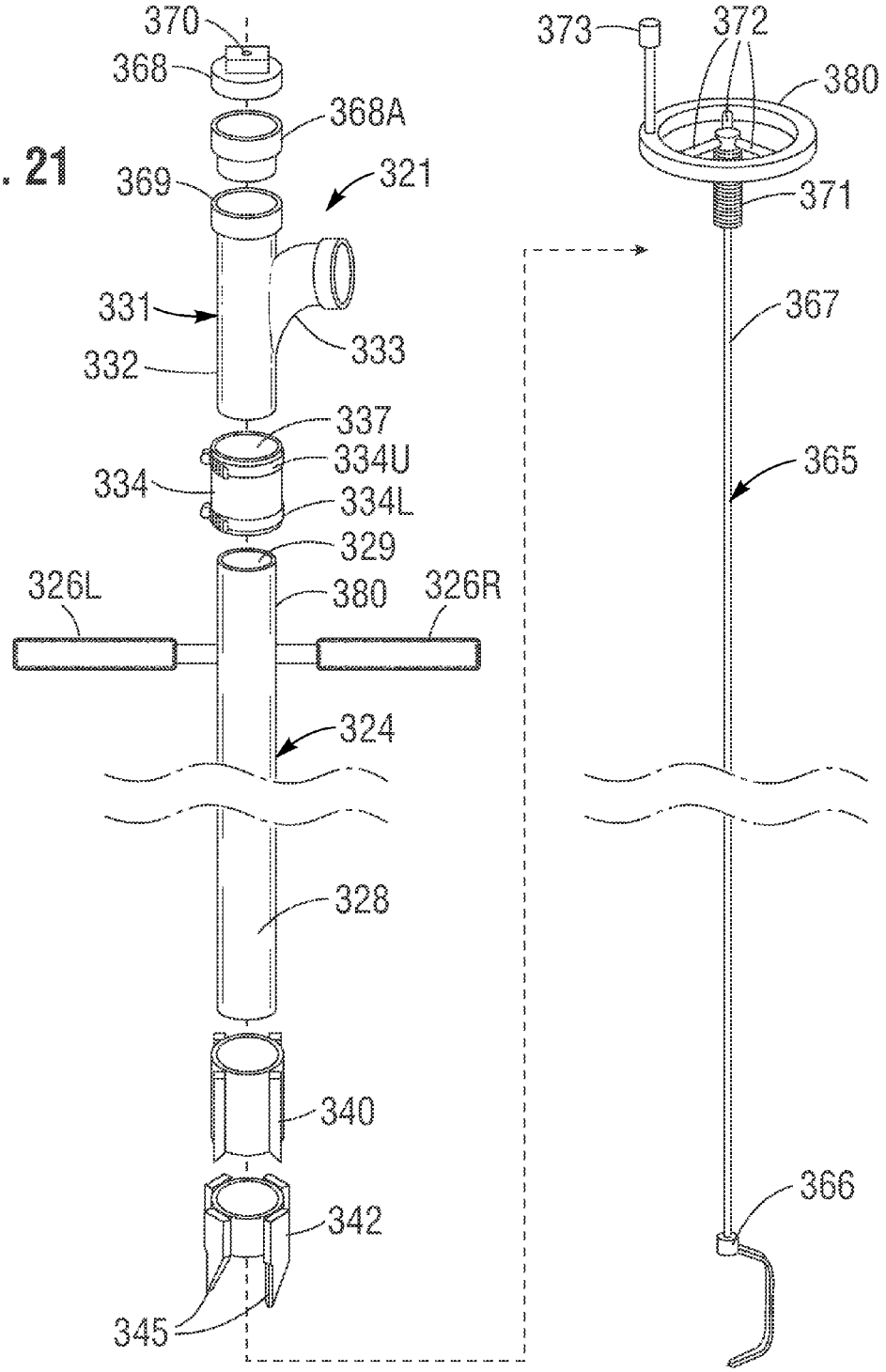
FIG. 21 is a partly exploded perspective view of the post hole digger tool of FIG. 20, showing a mud and clay unclogger bar of the tool removed from the tool housing.

FIGS. 20 and 21 illustrate a modification of the tool of FIG. 17, which includes a manually rotatable hand wheel for rotating a mud and clay unclogger bar of the tool.

Figure 1:
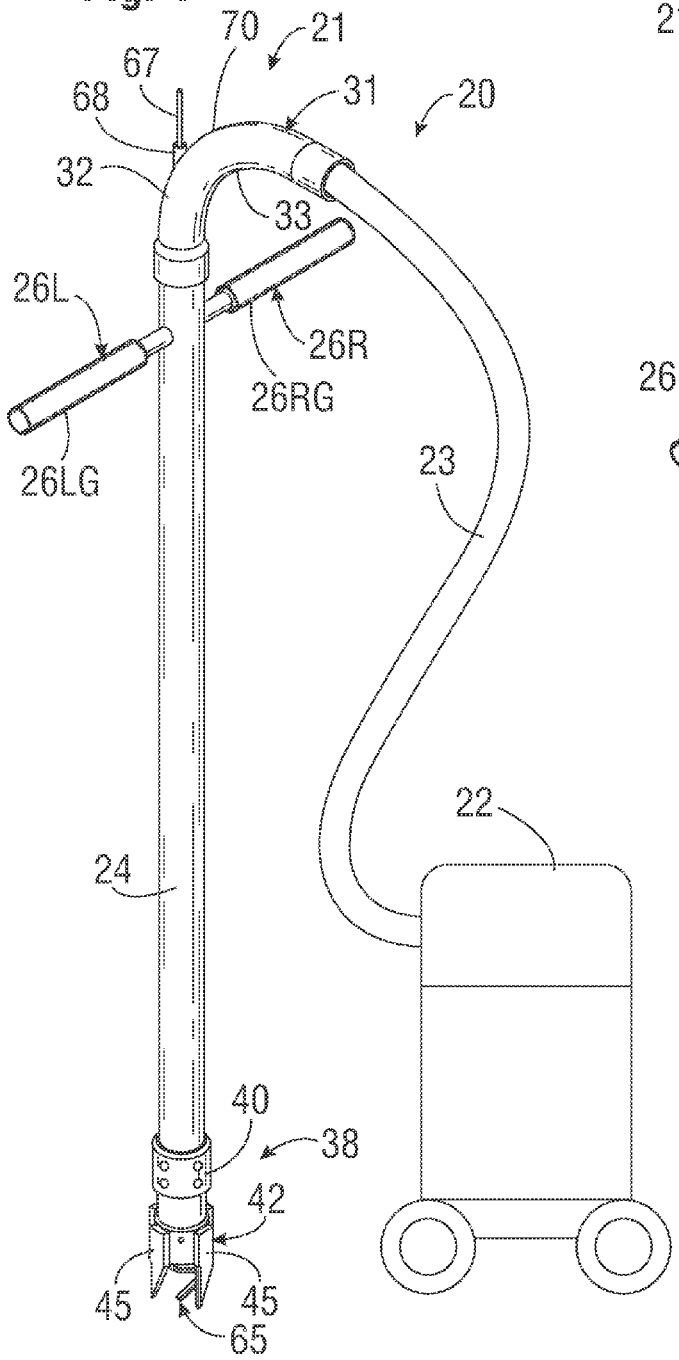
FIG. 1 is a perspective view of a vacuum assisted post hole digger apparatus with a rotary clog breaker according to the present invention.

Referring first to FIG. 1, a vacuum assisted post hole digger apparatus 20 may be seen to include a novel post hole digger tool 21 according to the invention, a vacuum source such as an electrically powered wet-or-dry shop vacuum unit 22, and a flexible vacuum hose 23 which interconnects the tool 21 and the vacuum source 22.

Figure 2:
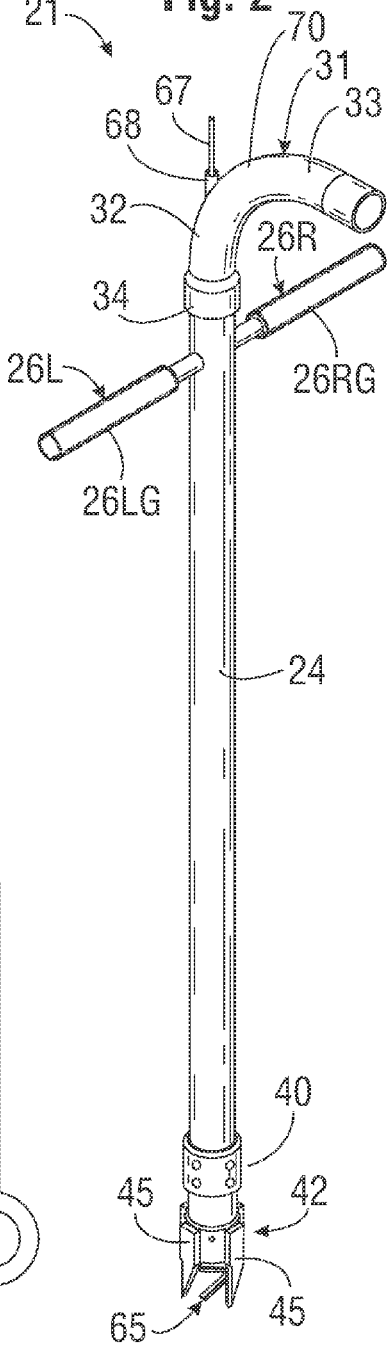
FIG. 2 is a perspective view of the vacuum assisted post hole digger tool part of the apparatus of FIG. 1.
Figure 3:
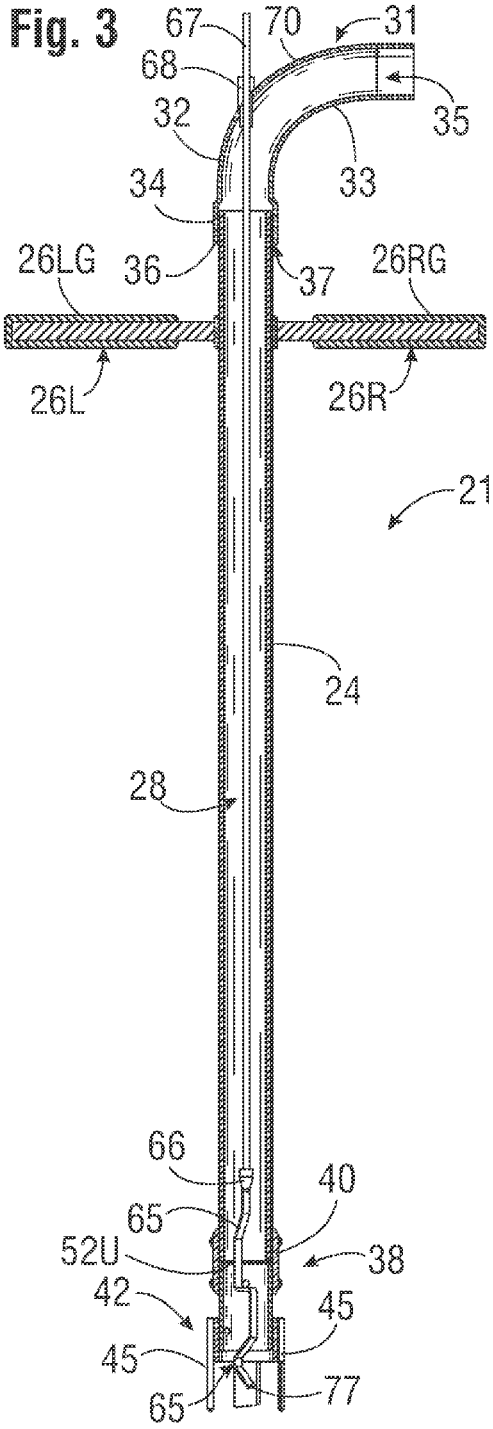
FIG. 3 is a longitudinal medial sectional view of the tool of FIG. 2.

As shown in FIGS. 1-3, vacuum assisted post hole digger tool 21 includes a straight, longitudinally elongated, circular cross-section cylindrical housing 24, which is made of heavy gauge steel or cast iron. Although the dimensions of housing 24 are not critical, example embodiments of the invention which were tested by the present inventor had outer diameters ranging between about 4 inches to 7 inches, and lengths of about six feet.

Figure 7:
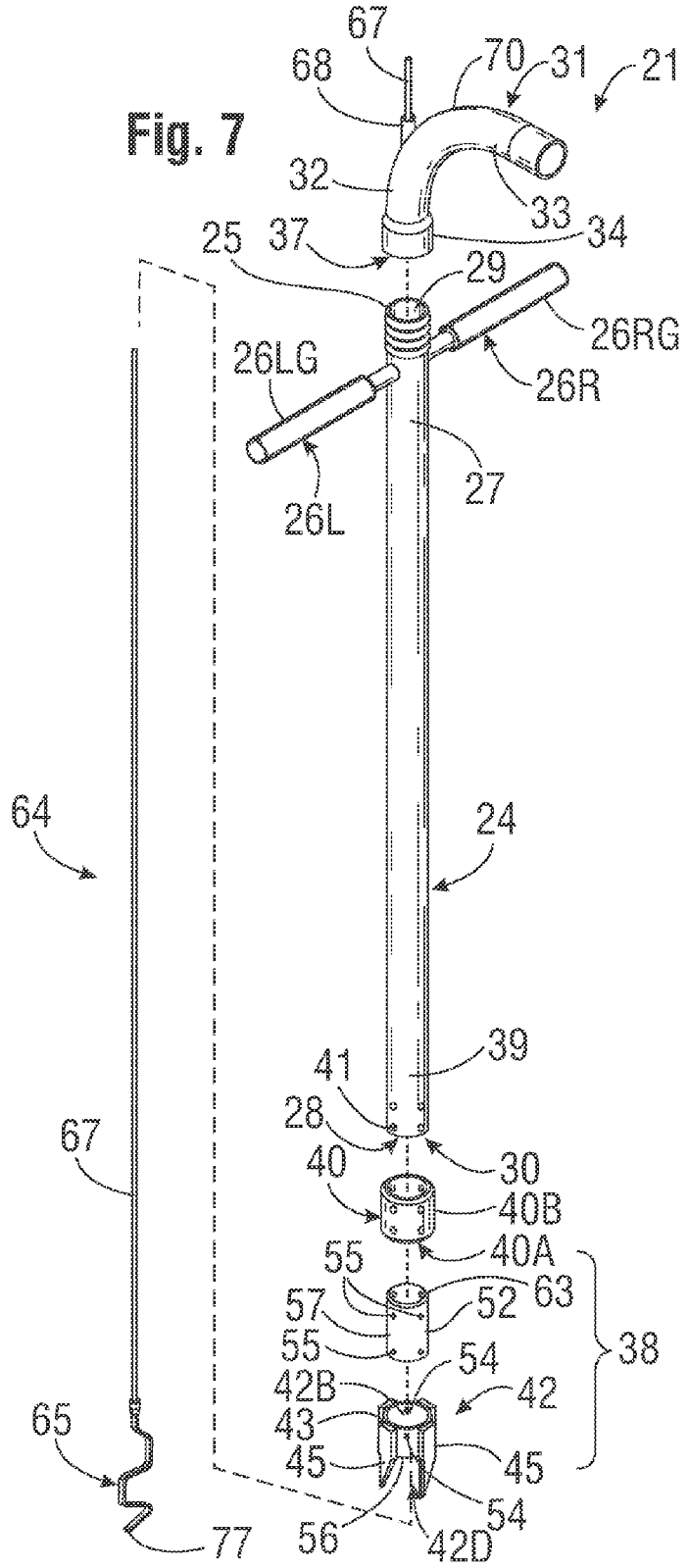
FIG. 7 is a partly exploded perspective view of an upper part of the post hole digger tool of FIG. 1, showing a mud and clay unclogger bar of the tool removed from the tool housing.

As shown in FIG. 7, housing 24 of tool 21 has located a short distance below upper transverse annular end wall 25 thereof a pair of straight, horizontally oriented left and right handle bars 26L, 26R, which are attached to and protrude perpendicularly outwards from diametrically opposed sides of the outer circumferential wall surface 27 of housing 24. Preferably, as shown in the figures, handlebars 26L, 26R have fitted over them insulating tubular rubber handle grips 26LG, 26RG.

Figure 8:
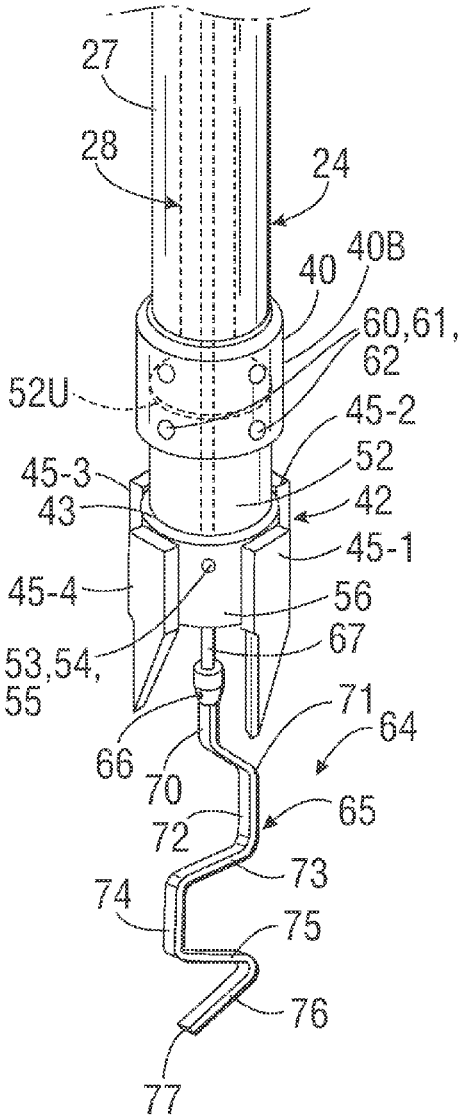
FIG. 8 is a fragmentary perspective view of a lower part of the tool of FIG. 2, showing the mud and clay unclogger bar thereof extended from the bore head thereof.

As shown in FIGS. 3, 7 and 8, housing 24 of tool 21 has disposed through its length a uniform diameter, circular cross-section bore 28 which has an upper opening 29 and a lower opening 30.

Referring to FIGS. 1, 3 and 7, it may be seen that post hole digger tool 21 includes a vacuum inlet tube 31, which preferably has the shape of a tubular right-angle elbow, that has a lower vertical section 32, and an upper horizontal section 33 which protrudes laterally outwards from the upper end of the vertical section.

As shown in FIGS. 3 and 7, tool 21 includes a coupler 34 for coaxially coupling the inner, vertical section of vacuum inlet coupler elbow 31 in a vacuum-light connection to the upper open end 29 of tubular housing 24, thus forming a smooth, hermetically sealed passageway between the elongated straight bore 28 of the housing and the curved bore 35 of the vacuum inlet elbow.

Figure 4:
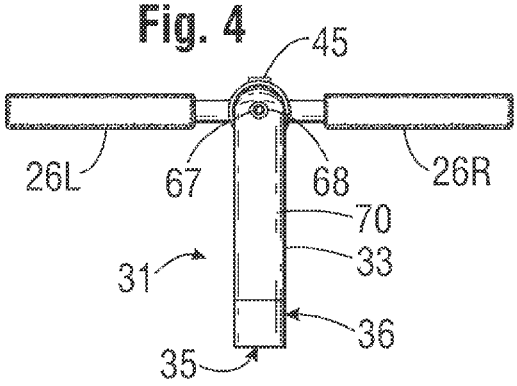
FIG. 4 is an upper plan view of the tool of FIG. 3.
Figure 7A:
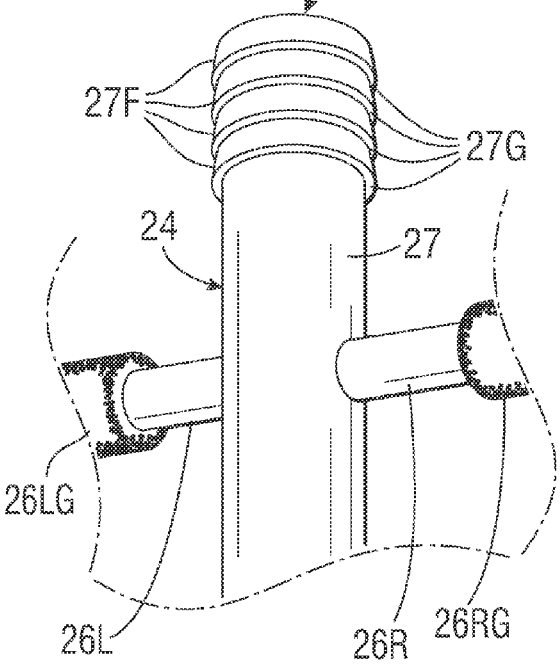
FIG. 7A is a fragmentary perspective view of the post hole digger tool of FIG. 7, on an enlarged scale, and showing an upper end of the housing modified to include alternating grooves and flanges.

FIGS. 3, 4 and 7 show a preferred construction of coupler 34 which includes a lower flange section 36 of vertical section 32 of vacuum inlet coupler 31 that has an enlarged diameter bore 37 that insertably receives the upper end of tubular housing 24. In a most preferred embodiment, coupler 34 is a rotary union-type which enables the lateral arm 33 of vacuum inlet tube elbow 31 to be rotated in a horizontal plane relative to the longitudinal axis of tubular housing 24. Preferably, as shown in FIG. 7A, the upper end of tubular housing 24 has formed in outer cylindrical wall surface 27 thereof a series of alternating, longitudinally spaced apart circular grooves 27G and flange barbs 27F, for frictionally securing against relative longitudinal movement a vacuum hose or vacuum inlet tube 31 connected to tubular housing 24.

Referring still to FIGS. 3 and 7, it may be seen that post hole digger tool 21 includes a bore head assembly 38 which is attached to a lower end 39 of tubular housing 24. As may be seen best by referring to FIGS. 6 and 7, bore head assembly 38 includes a cylindrical isolation collar 40 which fits coaxially over the outer circumferential wall 27 of tubular housing 24, and protrudes below the lower transverse end wall 41 of the housing. Isolation collar 40 is made of an electrically insulating material such as heavy rubber, and provides electrical isolation between housing 24 and a toothed bore head 42. The function of isolation collar 40 is to prevent an operator of tool 21 from receiving an electrical shock should bore head 42 inadvertently contact a live buried electrical cable, as will be explained below.

Figure 5:
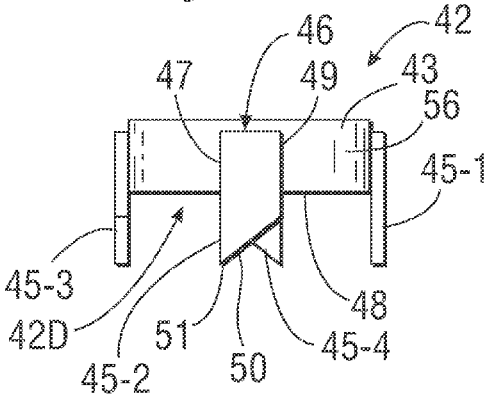
FIG. 5 is a fragmentary side elevation view of the post hole digger of FIG. 1 on an enlarged scale, showing a bore head component thereof.

As shown in FIGS. 5, 6, 7 and 8, bore head 42 of bore head assembly 38 includes a cylindrically-shaped base ring 43 that has attached to the outer cylindrical wall surface thereof a plurality of wedge-shaped cutting teeth 45. As shown in FIG. 5, each cutting tooth 45 includes an upper rectangular bar-shaped upper root section 46, a longer vertical edge 47 which protrudes downward below the lower transverse annular edge 48 of the base ring 43, a shorter vertical edge 49, and a lower straight edge 50 which angles obliquely downwards from the shorter vertical edge 49 to intersect at an acute angle the longer vertical edge 47 and form therewith a triangular vertex 51 which forms the cutting point of tooth 45.

Although the number and spacing of cutting teeth 45 may be varied, in an example embodiment of tool 21 which was tested by the present inventor and depicted in FIGS. 5-8, bore head 42 had four cutting teeth 45-1, 45-2, 45-3 and 45-4, spaced circumferentially apart at 90-degree intervals.

Referring to FIG. 7, it may be seen that tool 21 may optionally include an inner, connector sleeve 52 which is fastened coaxially within base ring 43, as by circumferentially spaced apart bolts 53 disposed radially through aligned holes 54 and 55 through the cylindrical walls of 56, 57, respectively of the base ring 43 and connector sleeve 52 with the lower transverse annular edge wall 59 of the connector sleeve aligned with lower transverse edge wall 59 of the bore head sleeve. Similarly, connector sleeve 52 is fastened at an upper end thereof within bore 40A of isolation collar 40 by bolts 60 disposed radially through aligned holes 61, 62 through the cylindrical wall 40B of isolation collar 40, and aligned holes through connector sleeve 52, located near the upper annular edge wall 63 of the connector sleeve.

As shown in FIGS. 3, 7 and 8, isolation collar 40 is attached to an inner connector sleeve 52 and the lower end of tubular housing 24 in a manner which creates an annular ring-shaped air gap 52U between the upper transverse annular end wall of the sleeve 52 and the lower transverse annular end wall 41 of tubular housing 24. Air gap 52U electrically isolates bore head 42 from tubular housing 24.

Figure 6:
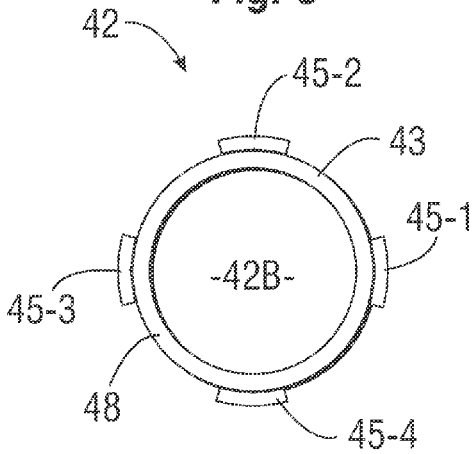
FIG. 6 is a lower plan view of the bore head component of FIG. 5.

As may be understood by referring to FIGS. 3,6, and 7, bore head 42 has longitudinally through its length a central coaxial bore 42B which preferably has a diameter at least as large as the diameter of bore 28 through housing 24, bore 42B communicating at an upper end with bore 28, and having a lower entrance opening 42D.

FIGS. 3, 7 and 8 illustrate the construction of a novel mud and clay unclogger component 64 of the tool 21.

As shown in FIGS. 3, 7 and 8, mud and clay unclogger 64 includes an elongated is joined at upper end thereof by a coupler collar 66 to an elongated drive shaft 67. Drive shaft 67, which preferably has a round cross-section, is disposed longitudinally upwards through the center of bore 28 through housing 24. As shown in FIGS. 1-4, the upper end of drive shaft 67 is rotatably mounted in the center of bearing 68 that is fitted into the upper wall 70 of vacuum inlet coupler elbow 31. Bearing 68 is coaxially aligned with the longitudinal center line of housing 24 and forms a vacuum-tight seal with upperwall 69 of elbow 31, so that air cannot leak from the exterior of elbow into the bore 35 through the elbow, when the air pressure in the bore is reduced below ambient atmospheric pressure by coupling the elbow to a vacuum source, such as a shop vacuum 22 shown in FIG. 1.

As may be seen best by referring to FIGS. 7 and 8, mud and clay unclogger bar 65 has a zig-zag shape formed by a series of flat sections which angle outwardly and inwardly with respect to the common longitudinal center lines of mud and clay unclogger bar coupler 66 and drive shaft 67, to form a zig-zag shape. Thus, as shown in FIG. 8, mud and clay unclogger bar 65 has a first upper straight vertical segment 65A coaxially aligned with coupler 66 and drive shaft 67, and a first, upper straight angled section 71 that angles radially outwardly and downwardly from the lower end of the upper straight section 65A. Mud and clay unclogger bar 65 also has a second straight vertical section 72 which extends downwardly from the lower end of first upper angled section 71. Second straight vertical section 72 is oriented parallel to the longitudinal center line of housing 24 and drive shaft 67, but is located on a first, e.g., right side of the common longitudinal center lines.

Referring still to FIG. 8, it may be seen that mud and clay unclogger bar 65 also has a second straight angled section 73 which extends radially inwardly and at a slight downward angle from the lower edge of second straight vertical section 72, and extends radially beyond the longitudinal center line of stirrer collar 66 to the left side of the center line. A third, left straight vertical mud and clay unclogger bar segment 74 extends downwardly from the lower left end of second angled mud and clay unclogger bar segment 73, and is joined at a lower end thereof by third right-wardly and downwardly angled straight section 75. The lower end of section 75 is terminated by a terminal downwardly and radially inwardly angled, bottom angled straight segment 76, which forms with segment 75 a V-shaped lower end section. As shown in FIGS. 1 and 2, the lower end 77 of lowest mud and clay unclogger bar segment 76 is approximately aligned with the lower transverse edges of cutting teeth 45.

Figure 9:
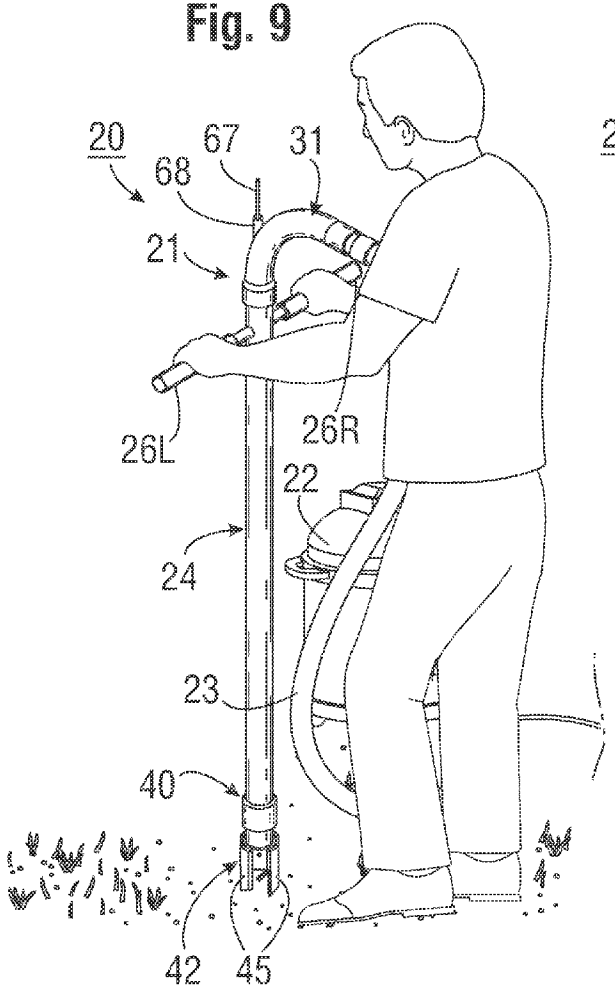
FIG. 9 is a perspective view of the post hole digger tool of FIG. 1, showing the tool connected to a vacuum source and positioned above a ground surface preparatory to using the tool to dig a hole in the ground.

FIGS. 9-13 show how vacuum assisted post hole digger apparatus 20 according to the present invention is used. As shown in FIG. 9, left and right handles 26L, 26R of post hole digger tool 21 are grasped in the left and right hands, respectively, of an operator A. The tool 21 is then positioned vertically above a location in which a hole is to be dug, and the points of the cutting teeth 45 inserted into the soil, using a downward force exerted on the teeth by the weight of tool housing 24, and, if necessary, additional downward force exerted on handles 26L, 26R by the operator.

Next, as shown in FIGS. 1 and 9, a vacuum hose 23 is connected at one end to elbow 31, and at the other end to a vacuum source such as a wet-or-dry shop vacuum 22.

Figure 12:
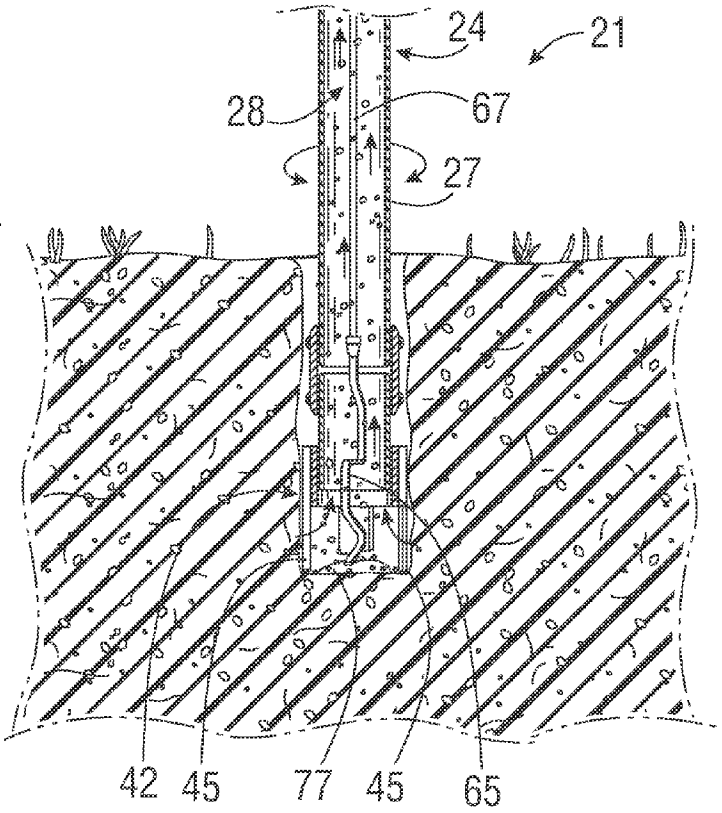
FIG. 12 is a view similar to that of FIG. 11, showing severed soil being drawn up through the bore of the tool by vacuum.
Figure 11:
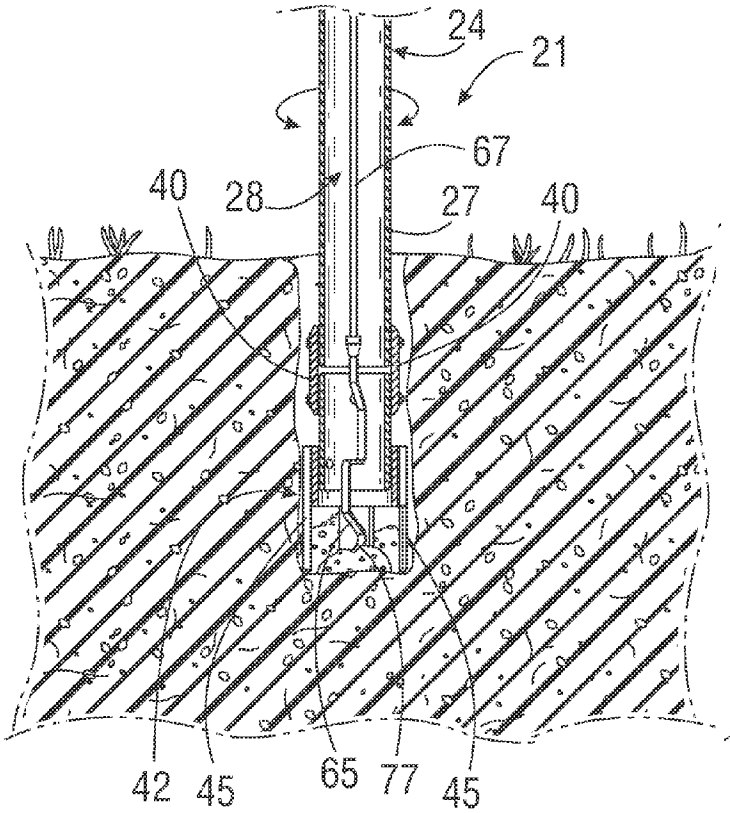
FIG. 11 is a longitudinal sectional view of the arrangement of FIG. 9, showing how the tool of FIG. 1 is used to severe soil.

Then, as shown in FIGS. 9 and 11, handles 26L, 26R are used to oscillate, toggle or rock housing 24 alternately in clockwise and counterclockwise directions relative to the longitudinal axis of the housing, in angular excursions of approximately 90-180 degrees clockwise and 90-180 degrees counterclockwise. This action causes cutting teeth 45 of severed soil, as shown in FIG. 11. Negative pressure within bore 28 of tubular housing 24 and bore 42B of bore head 42 causes severed soil to be drawn up through the bore 28 of tool housing 24, as shown in FIG. 12, thus facilitating rapid downward vertical digging motion, as shown in FIGS. 11 and 12.

As shown in FIGS. 1,2,5 and 6, the location of cutting teeth 45 on the outer cylindrical wall surface of base ring 43 forms a longitudinally disposed, annular arc-shaped gap between circumferentially spaced apart longitudinal edges of each pair of adjacent teeth. These gaps enable free flow of severed soil from the bore hole into the bore 28 of housing 24, thus minimizing the possibility of forming a vacuum blockage of bore 28, which would require withdrawing the housing vertically upwards in a bore hole being formed to clear the vacuum blockage.

Figure 10:
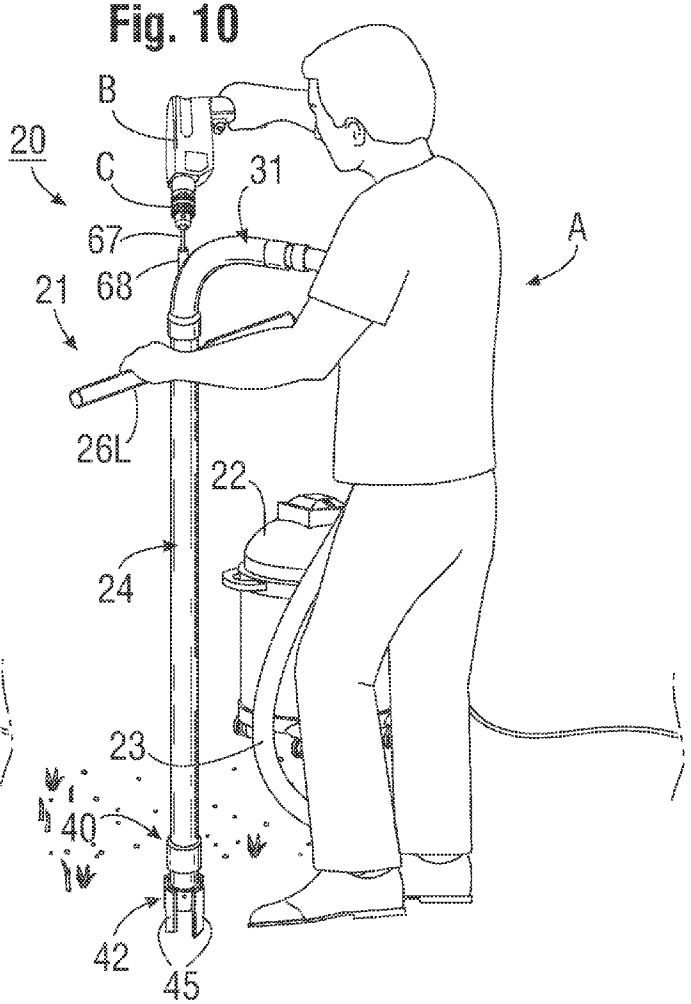
FIG. 10 is a view similar to that of FIG. 9, showing the post hole digger tool of FIG. 1 being readied to dig a hole in muddy soil.
Figure 13:
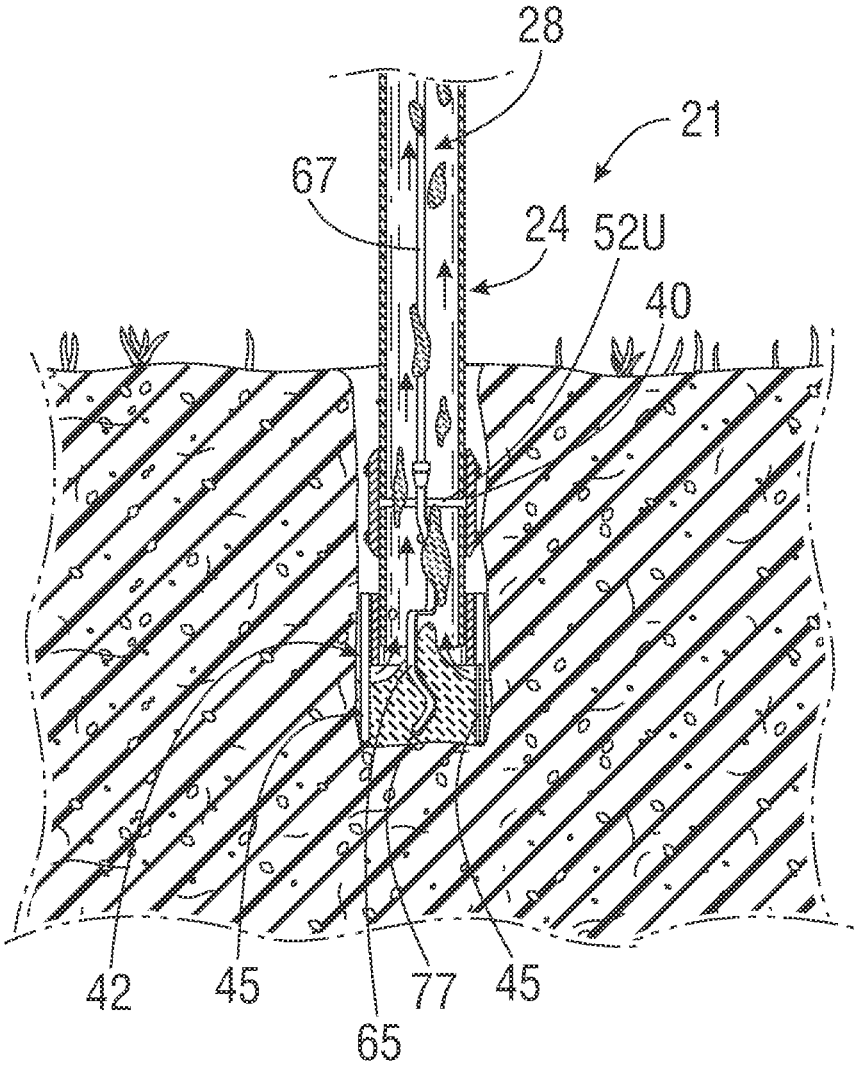
FIG. 13 is a longitudinal sectional view of the tool of FIG. 10, showing a mud and clay unclogger bar of the tool being rotated to break up mud clogs.

FIGS. 10 and 13 illustrate how apparatus 20 is used to dig holes in wet or clay bearing soil. As shown in FIG. 9, the positioning of tool 21 relative to a ground surface of wet soil in which a hole is to be dug is similar to that shown in FIG. 9, in using the tool to dig a hole in dry soil. Moreover, the toggling or pivoting of the housing 24 of the tool 21, and general procedure for using the tool, are similar for both dry and wet soil. However, as shown in FIG. 10, when the bore 28 of tool housing 24 tends to become clogged because of wet, muddy or clay soil lodging within the bore, the upper end of stirrer rod drive shaft 67 that protrudes upwardly from vacuum inlet coupler elbow 31 is connected to a rotary power source, such as by clamping the end of the drive shaft in the chuck C of an electric drill B. The rotary power source is then energized, causing the zig-zag shaped mud and clay unclogger bar 65 located at the bottom end of rotating drive shaft 67 to slice through and pulverize mud clogs and clay, thus restoring efficient vacuuming of dirt and mud or clay through the bore 28 of tool housing 24.

FIGS. 14-16 illustrate a modification 81 of the vacuum post hole digger tool shown in FIGS. 1-13 and described above. Modified post hole digger tool 81 has a bore head 102 of larger diameter than bore head 42 shown in FIGS. 1-8, and includes a frusto-conically shaped tubular transition section 140. Transition section 140 has an upper diameter approximately equal to that of tubular housing 84 of tool 81, and a larger lower diameter equal to that of larger diameter bore head 102.

FIG. 17 illustrates another modification 20A of tool 20 shown in FIGS. 1-8 and described above. Modified tool 20A has an integral drive motor 180 which replaces an external rotary power source such as the electric drill B shown in FIG. 10. As shown in FIG. 17, motor 180 is attached to a vacuum inlet tube elbow 31 by a bracket assembly 181. Electrical power is supplied to drive motor 180 by a power cord 182, which preferably is attached to the exterior of vacuum hose 23. Preferably, power cord 182 includes a neutral conductor 183 which is connected directly to motor 180, and a hot conductor 184 which is connected to the drive motor through an on/off switch 185 mounted on a handle bar grip 26RG.

FIGS. 18-19 illustrate a modified bore head 242 for use with the vacuum assisted post hole digger tools 21, 81 and 211 described above. As shown in FIGS. 18 and 19, modified bore head 242 has a longitudinally elongated circular cross-section, hollow tubular teeth-anchor body 243. Teeth anchor body 243 has an elongated upper elongated cylindrically-shaped connection tube section 230, which at a lower transverse end thereof tapers radially inwardly to a smaller diameter, short neck section 231.

The lower end of neck section 231 tapers radially outwardly to a longer teeth support section 232 of larger diameter than both upper connection tube section 230 and intermediate neck section 231. As may be seen best by referring to FIG. 19, teeth support section 232 has a generally uniform wall thickness. Thus, a lower generally cylindrically-shaped section 233 of teeth support section 232 has a generally cylindrically-shaped bore 234 which at the upper end thereof tapers radially inwardly via an angled annular transition section 235 to join a cylindrical inner bore 236 which is disposed longitudinally through neck section 231 and upper connection tube section 230.

As shown in FIGS. 18 and 19, bore head 242 has attached to the outer cylindrical wall surface 244 of lower tooth support section 232 thereof a plurality of cutting teeth, including a first set of four axial cutting teeth 245A, 245B, 245C, 245D, which are spaced circumferentially apart at 90-degree intervals. As shown in FIGS. 18 and 19, axial cutting teeth 245 are approximately parallel to the longitudinal axis of cutting tooth anchor body 243. Each axial cutting tooth 245 has a short, rectangular bar-shaped, upper root section 246, which is fastened to a flat 296 to the outer cylindrical wall surface 244 of the lower tooth support section 232.

Referring still to FIGS. 18 and 19, if may be seen that bore head 242 also has attached to outer cylindrical wall surface 244 of the bore head a second set of four angled cutting teeth 265A, 265B, 265C, 265D, which are located circumferentially midway between each pair of axial cutting teeth 245, and hence are also spaced apart circumferentially at 90-degree intervals. As shown in FIG. 19, each angled cutting tooth 265 has a relatively long, radially inwardly bent upper root section 266, which is fastened to both a flat 296 of the lower part of outer cylindrical wall surface 244 of lower tooth support section 232, at an intermediate longitudinal location of each tooth, and to an upper arcuately inwardly curved wall surface 297 of outer wall surface 298 of tooth support section 222 at an upper location of each tooth, each tooth having at an outer lateral edge thereof an acutely angled, wedge-shaped cutting point.

Referring to FIGS. 18 and 19, it may be seen that each cutting tooth 245, 265 has a similar symmetrical shape. Thus, as shown in FIG. 18, each cutting tooth 245, 246 has circumferentially spaced apart, longitudinally disposed straight, parallel left and right sides 247, 249 which are coextensive with left and right sides of upper tooth section 246 of each tooth. As shown in FIG. 18, each tooth 245, 265 has a lower transverse edge 250 which is spaced longitudinally below the lower transverse annular end wall 248 of lower tooth support section 232 of bore head 242. Lower transverse edge 250 has extending longitudinally upwards therein a symmetrically shaped notch 270 having the shape of an isosceles triangle, thus forming left 271 and right 272 cuspids of a bicuspid-shaped tooth, each having at an outer edge thereof an arcuately angled, wedge-shaped cutting point.

As may be seen best by referring to FIG. 19, each tooth 245, 265 has in transverse section the shape of regular prism, including a central section having flat and parallel inner and outer longitudinally disposed rectangular sides 272, 273, and left and right triangular cross-section side section 274, 275, the outer longitudinally vertices 276, 277 of which form longitudinally disposed, wedge-shaped knife edges.

FIGS. 20 and 21 illustrate a modification 321 of post hole digger tool 21 shown in FIGS. 1-3 and 7, and tool 20A shown in FIG. 17 and described above. The construction and function of modified post hole digger 321 is substantially similar to that of tool 20 described above. Therefore, in the ensuing description of tool 321, a description of the structure and function of elements of tool 321 which are analogous to those of elements of tool 20, and have the number 300 added to the corresponding element of tool 20, will not be repeated here.

Modified tool 321 has a modified mud and clay unclogger bar 365, which is fitted at the upper end thereof with a hand wheel 380 that enables the unclogger bar to be manually rotated, and also has a modified vacuum inlet tube 331.

As shown in FIGS. 20 and 21, modified vacuum inlet tube 331 has generally the shape of tubular Tee member which has a circular cross-section vertical in-line section 332, and a horizontal side tube section 333 which protrudes laterally outwards from a side of the vertical in-line section.

As shown in FIGS. 20 and 21, tool 321 includes a tubular coupling clamp 334 for coaxially coupling the open lower end of the vertical in-line section 332 of vacuum inlet coupler Tee 331 in a vacuum-tight connection to the open upper end 329 of an elongated tubular tool housing 324, thus forming a smooth, hermetically sealed passageway between the elongated straight bore 328 of the tool housing 324 and the bore 335A through the vertical section 332 of the vacuum inlet Tee 331.

As shown in FIGS. 20 and 21, coupler 334 has through its length a longitudinally disposed circular cross-section bore 337 which has an upper opening that insertably receives the lower end of vertical in-line section 332 of inlet coupler Tee 331. Bore 337 of coupler 334 also has a lower opening which insertably receives the upper end of tool housing 324.

As shown in FIG. 21, tool 321 includes a pair of circular ring-shaped upper and lower hose clamps 334U, 334L which are tightenable onto the cylindrical outer wall surface of coupler 334 to secure the coupler to in-line section 332 of vacuum inlet coupler Tee 331 and tool housing 324. Optionally, coupler 334 may be replaced with a rotatable union type coupler of the type depicted in FIG. 7 and described above.

As shown in FIGS. 20 and 21, tool 321 includes an elongated longitudinally disposed rectangularly cross-section, zig-zag shaped unclogger bar 365 which is substantially similar in structure and function to unclogger bar 65 shown in FIGS. 7 and 8 and described above.

As is also shown in FIGS. 20 and 21, mud and clay unclogger bar 365 has an elongated drive shaft 367 which is disposed longitudinally upwards through the center of bore 328 through tool housing 324. The upper end of unclogger bar drive shaft 367 is rotatably mounted in the center of a bearing cap 368 which is joined by a stepped diameter cylindrical adapter coupling 368A to the upper opening of vertical in-line section 332 of vacuum inlet coupler Tee 331. Bearing 368 is coaxially aligned with the longitudinal center line of tool housing 324, and forms a vacuum-tight seal with upper end 369 of in-line section 332 of vacuum inlet coupler Tee 331. With this construction, air cannot leak from the exterior of the vacuum inlet coupler Tee 331 into the bore 335 through the Tee, when air pressure in the bore is reduced below ambient atmospheric pressure by coupling the side tube section 333 of the Tee to a vacuum source such as a shop vacuum 22, in the manner shown in FIG. 1.

Referring still to FIGS. 20 and 21, it may be envisioned that the upper end of unclogger bar drive shaft 367 extends upwardly through a central coaxial bore 370 which is disposed through bearing cap 368. The upper end of the unclogger bar drive shaft has attached to its outer surface an enlarged diameter, elongated coaxial collar 371. Collar 371 is joined at its upper end to radial spokes 372 which are joined at the outer ends thereof to circular ring-shaped hand wheel 380. Hand wheel 380 has extending perpendicularly upwards from an upper surface thereof a crank handle 373, which may bed grasped in a person's hand and orbited by wrist motion to thus rotate hand wheel 380 and attached unclogger bar 365.

Optionally, hand wheel 380 may be removably fastened to collar 371 so that the the collar 371 at the upper end of the unclogger bar drive shaft 367 may be coupled to and rotatably driven by a hand-held rotary motor in the manner shown in FIG. 10, or by a motor removably attached to vacuum inlet Tee 331, in the manner shown in FIG. 17.

What is claimed:

1. A tool for boring holes in soil comprising;

a. a longitudinally elongated tubular housing having disposed through its length a vacuum bore, said housing having at an upper end thereof an upper opening which communicates with said bore, and is connectable to a vacuum source, and said housing having at a lower end thereof a lower opening which communicates with said vacuum bore, b. a bore head assembly fastened to a lower end of said housing, said bore head assembly including at a lower end thereof a structure for severing soil, said bore head assembly having disposed longitudinally therethrough a central coaxial bore which has an open lower end and communicates at an upper end thereof with said vacuum bore through said housing, c. a vacuum inlet tube having an inner leg connectable to said upper opening of said housing and an outer leg connectable to a vacuum source, said inner leg of said vacuum inlet tube being longitudinally disposed and said outer leg being transversely disposed, d. an elongated rotatable unclogger bar which is disposed through said central coaxial bore through said bore head assembly and at least a lower part of said vacuum bore of said housing, said unclogger bar having an angled lower end portion, e. a rotary drive mechanism for rotating said unclogger bar, said rotary drive mechanism for rotating said unclogger bar including in combination:

I. an elongated drive shaft which has a lower end joined by a coupler to an upper end of said unclogger bar, ii. a bearing which is axially aligned with said vacuum bore through said tubular housing, said bearing being located at an upper end of said tubular housing and rotatably receiving an upper end of said drive shaft which protrudes outwards of said housing, and iii. a hand wheel which is removably attachable to said protruding upper end of said unclogger bar drive shaft.

2. The tool of claim 1 wherein said unclogger bar is further defined as having a zig-zag shape.

3. The tool of claim 1 wherein said unclogger bar is further defined as comprising a uniform transverse cross-section elongated member which is formed into a zig-zag shape.

4. The tool of claim 3 wherein said unclogger bar is further defined as having a rectangular transverse cross-sectional shape.

* * * * *